United States Patent [19]

Jones

[11] 4,050,271

[45] Sept. 27, 1977

[54] APPARATUS FOR REPAIRING INDENTIONS IN A RIGID SKIN

[75] Inventor: Noel C. Jones, Frederick, Okla.

[73] Assignee: Noel C. Jones & Associates, Inc., Frederick, Okla.

[21] Appl. No.: 684,399

[22] Filed: May 7, 1976

Related U.S. Application Data

[63] Continuation-in-part of Ser. No. 481,168, June 20, 1974, Pat. No. 3,977,230.

[51] Int. Cl.[2] ..... B21D 1/12; B21C 51/00

[52] U.S. Cl. ..... 72/37; 72/409; 72/705

[58] Field of Search ..... 72/37, 418, 705, 409

[56] References Cited

U.S. PATENT DOCUMENTS

| | | | |
|---|---|---|---|
| 1,112,544 | 10/1914 | McCarroll | 72/37 |
| 1,745,550 | 2/1930 | McCarroll | 72/37 |
| 2,256,130 | 9/1941 | Trachsel | 72/705 X |
| 2,435,726 | 2/1948 | Rohde | 72/705 X |
| 2,941,429 | 6/1960 | Mason | 72/705 X |
| 2,949,144 | 8/1960 | Dredske et al. | 72/705 X |
| 3,030,837 | 4/1962 | Chartier | 72/705 X |
| 3,066,719 | 12/1962 | Selnick | 72/705 X |
| 3,180,128 | 4/1965 | Faulkner | 72/409 |
| 3,187,538 | 6/1965 | Painter | 72/705 X |

*Primary Examiner*—C.W. Lanham
*Assistant Examiner*—D. M. Gurley
*Attorney, Agent, or Firm*—Dunlap, Codding & McCarthy

[57] ABSTRACT

An improved apparatus for repairing indentions in a rigid skin, the apparatus comprising a frame supportingly holding a transparent base plate that is positioned to rest on a portion of the skin in close proximity to the indention. A chuck assembly is slidingly supported by the frame to grippingly hold and movably position a dent engaging member that contacts the dented portion of the skin. A retraction assembly moves the chuck assembly in a direction to pull the dented portion towards the base plate.

7 Claims, 5 Drawing Figures

APPARATUS FOR REPAIRING INDENTIONS IN A RIGID SKIN

REFERENCE TO RELATED PATENT APPLICATIONS

The present invention is a continuation-in-part to a U.S. Pat. application entitled "Apparatus for Repairing Indentions in a Rigid Skin", Ser. No. 481,168, filed June 20, 1974, now U.S. Pat. No. 3,977,230.

BACKGROUND OF THE INVENTION

1. Field of the Invention

The present invention relates to improved apparatus for repairing indentions in a rigid skin, and more particularly, but not by way of limitation, to an improved apparatus for repairing dents in the metal skin of the body of an automobile.

2. Description of the Prior Art

In the construction of vehicles and the like, an outer skin surface often forms a body so as to enclose the operative parts of the vehicle, and to function as the outer skin in the wind stream created while the vehicle is moving. Examples of such vehicles are automobiles, trucks, travel trailers and airplanes. In the use of such vehicles and the like, the outer skin may be exposed to accidental damage brought about by normal usage in traffic, and may incur damage from weather elements, including hail, snow and rain. These are examples of the abuse generally created by external forces brought against the skin surfaces of vehicles and the like. As a result thereof, it often happens that indentations, or dents, are caused in the facade or skin surfaces, and it is often necessary or desirable to restore the skin surfaces to their original shapes.

Repair to outer skin surfaces, such as automobile body surfaces, is performed by a number of techniques. If damage is very extensive, it may be necessary to remove part of the outer skin, such as for example a fender, and to replace the removed part with a new or rebuilt component. If the body skin is dented, the dented area may be built up by adding material to fill in the dent, and surface finishing techniques are used to match the appearance of the repaired areas with the appearance of the surrounding surfaces. Yet another way of repairing dents in body skin surfaces is to force the dented area back to its original shape, or at least to approximately its original shape, by applying a force against the dented area in a direction generally opposite to the direction of impression of the dent.

It is a relatively easy matter to repair dented portions of a body skin when it is possible to have free access to the back or dent protrusion side of the body skin. However, it is a different matter when the body skin is constructed in a manner so as to enclose a space wherein it is impracticable to work the rear side of the body skin. In this case, techniques have been worked out to pull the dent from the side of impression by attaching a pulling member to the area of indentation, such as by the use of a welding rod or the like.

Several prior art patents that teach apparatus practicing techniques of dent straightening are U.S. Pat. No. 2,949,144, issued to Dredske et al; U.S. Pat. No 3,545,250, issued to Jones; U.S. Pat. No. 3,187,538, issued to Painter; U.S. Pat. No. 3,091,983, issued to Kliss; U.S. Pat. No. 2,799,190 issued to Awot; U.S. Pat. No. 2,957,376, issued to Parisi; U.S. Pat. No. 2,749,795 issued to Boykin, Jr.; U.S. Pat. No.3,066,719, issued to Selnick; and U.S. Pat. No. 2,605,658, issued to Sanchez.

While the prior art has generally met with success in repairing indentations in the body skin of automobiles and the like, usually the machinery or apparatus to perform the same has been bulky, or at best, rather awkward to manipulate. This is especially true when a vehicle has a large number of indentations, such as when an automobile has suffered the effects of multiple indentations caused by the striking thereof by falling ice or hail. Not only must a large number of impressions or dents be straightened, it is generally to be expected that the body skin is covered by paint or by a vinyl covering, such as in vinyl-topped automobiles, in which case it is undesirable to mar the surface as is generally required by most prior art devices.

Yet another problem with the straightening of dents is that of overpulling the indented portion wherein there is caused a positive protrusion after pulling the dent back to the surface. In other word, the metal skin forming the dented portion is plastically deformed so that it is not returned to its original shape.

SUMMARY OF THE INVENTION

The present invention provides an improved apparatus for straightening an indentation in a metal skin or the like wherein a dent-engaging member is placed in contact engagement with the dent, and a frame, a transparent base plate, a chuck assembly and a rectracting assembly cooperatively pull the dent-engaging member so as to force the indented portion of the body skin back to its original shape while the plastic deformation of the dented metal is observed and monitored.

Accordingly, an object of the present invention is to provide an improved dent-straightening apparatus that easily and quickly attaches to and removes the dent.

Another object of the present invention is to provide an improved dent-straightening apparatus that easily and quickly reforms the dented portion while being continuously observable and monitored.

Another object of the present invention is to provide an improved dent-straightening apparatus that prevents overpull of the dented area.

Another object of the present invention is to provide an improved dent-straightening apparatus that minimizes the marring of the dented area while straightening.

Other objects and advantages of the invention will be evident from the following detailed description when read in conjunction with the accompanying drawings which illustrate a preferred embodiment of the invention.

DESCRIPTION OF THE PREFERRED EMBODIMENT

Figure 1:
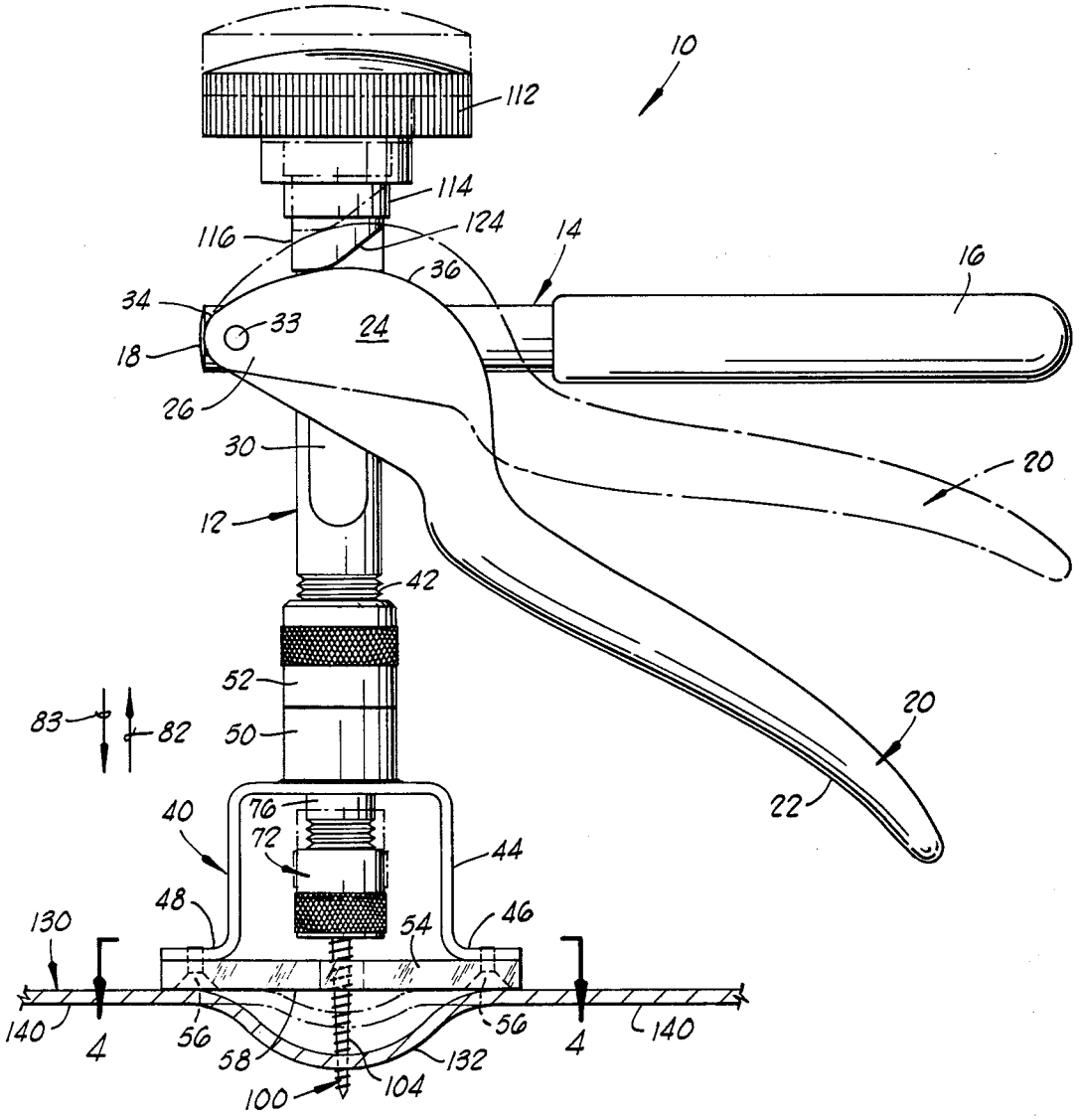
FIG. 1 is a side elevational view of the improved dent-straightening apparatus of the present invention.
Figure 2:
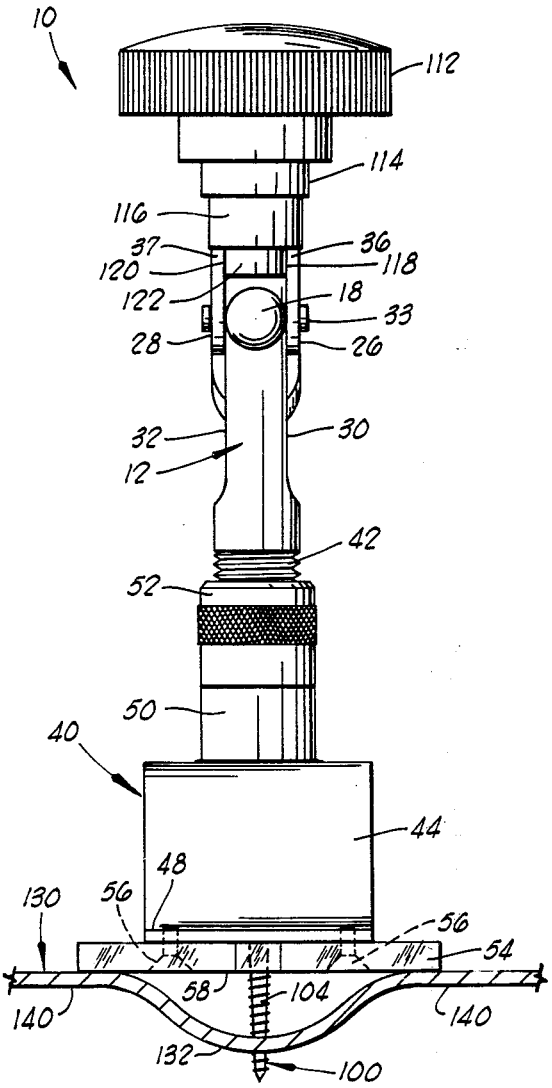
FIG. 2 is a front elevational view of the dent-straightening apparatus shown in FIG. 1.

Referring to the drawings, and particularly to FIGS. 1 and 2, the improved dent-straightening apparatus of the present invention is illustrated and generally designated by the numeral 10. The apparatus 10 basically comprises a frame member 12 that has a stationary handle member 14 extending therefrom. As appearing in FIG. 1, the handle 14 has a sleeve 16 that is made of a polymeric material.

Also extending from the frame member 12 is a pivot support member 18. A movable handle 20 is designed to be pivotally supported by the pivot support member 18 in a manner that the movable handle 20 can assume an extend position as shown in FIG. 1 by the solid line depiction of the movable handle 20, and the movable handle 20 can be pivoted toward the stationary handle 14 to assume a retract position as shown in FIG. 1 by the broken line depiction of the movable handle 20.

The movable handle 20 has a gripping portion 22 and a tines portion 24, the latter comprising a first tine portion 26 and a second tine portion 28. The frame member 12 is a generally tubular shaped member having a first flatted surface 30 on one side of the frame 12 and a second flatted surface 32 on the opposing side of the frame 12 as may be viewed in FIG. 2. The tines portion 24 is disposed so that the first tine portion 26 is adjacent to the first flatted surface 30, and the second tine portion 28 is adjacent to the second flatted surface 32. A pivot pin 33 is disposed in an appropriately placed aperture in the pivot support member 18 and passes through a pair of aligned apertures located in the edge portions 34 of the first and second tine portions 26, 28. The pivot pin 33 serves as an arbor for rotation of the movable handle 20 relative to the frame 12. The top surfaces 36 and 37 respectively of the first and second tines portion 26 and 28 are curved into a cam shape for a reason that will be discussed below.

A base plate assembly 40 is supported at a lower threaded end 42 of the frame member 12. The base plate assembly 40 has a frame member 44 that is formed into a generally C-shaped configuration having outwardly flaring ears 46 and 48. Attached to the frame member 44 is an internally threaded collar connector 50 that is threadily engagable with the lower end 42 of the frame member 12. An internally threaded back-up collar 52 is disposed over the lower end 42 and serves to tighten against the collar connector 50 to lock the base plate assembly 40 on to the frame member 12.

The base plate assembly 40 further comprises a base plate 54 that is connected to the ears 46 and 48 of the frame member 44 via conventional screw bolts 56 that pass through apertures in the base plate 54 and which engage threaded apertures located in the ears 46, 48. The bolts 56 are countersunk into the base plate 54 so as to be flush with the surface 58 of the base plate 54.

The base plate 54 is made from a transparent material such as a plastic or polymeric material. An acceptable material for the base plate 54 is a transparent, polycarbonate plastic made by the Rohm and Haas Company Under the trademark "Tuffak". The base plate 54 serves as a back-up member to a dent that is removed with the dent-straightening apparatus 10, and as such, the base plate 54 should have the necessary strength to perform this function. Also, the base plate 54 should have sufficient transparency so that an operator of the dent-straightening apparatus 10 can view the results achieved, as will be made clear below.

Figure 3:
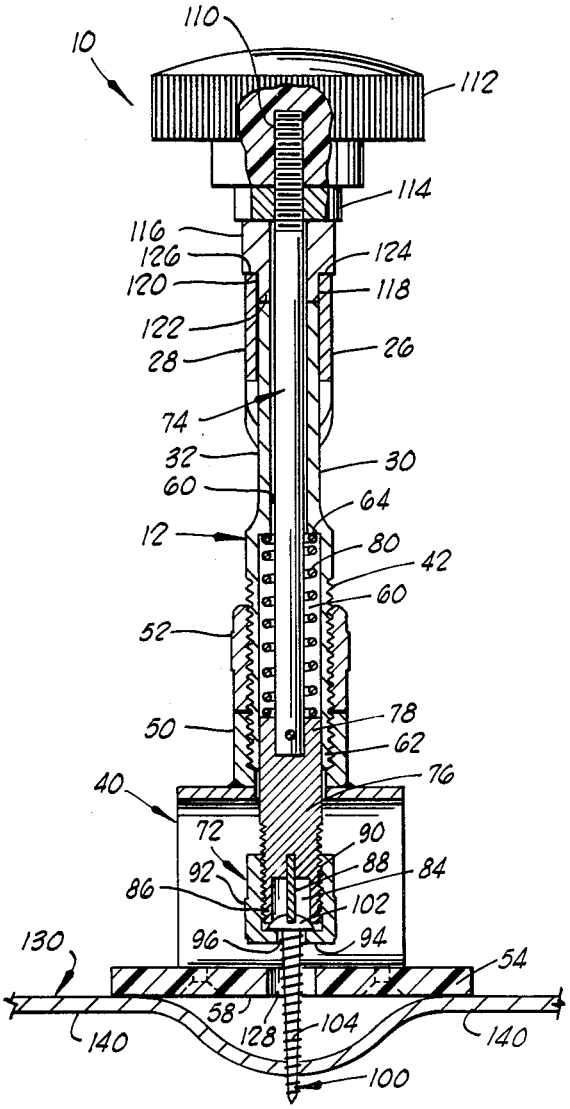
FIG. 3 is a front elevational view, shown in partial cutaway depiction, of the dent-straightening apparatus of FIG. 1.

As best viewed in FIG. 3, which is a cutaway of the dent-straightening apparatus 10, the frame member 12 is a generally tubular shaped member having a chamber 60 extending from the tip portion 62 of the lower end 42 to an abutting shoulder portion 64. A smaller bore 66, co-axial with the chamber 60, extends through the remaining portion of the frame member 12.

A chuck assembly 70 is slidingly supported in the chamber 60 and the bore 66 that passes through the frame member 12. The chuck assembly 70 comprises a chuck 72 and a slide rod 74. The chuck 72 comprises a cylindrically shaped chuck member 76 that has an external diameter sized to be receivable in the chamber 60. This slide rod 74 is attached to the upper end 78 of the chuck member 76, and the slide rod 74 is sized to clearingly extend through the smaller bore 66. A coil spring 80 is disposed in the chamber 60 about the slide rod 74 and extends between the upper end 78 of the chuck member 76 and the shoulder portion 64. As the chuck assembly 70 is moved in a first direction 82, also called the retracting direction, the spring 80 will be compressed between the shoulder portion 64 and the chuck member 76.

Continuing with the chuck 72, the cylindrically shaped chuck member 76 is hollow at one end, having a bore 84 that extends into the end 86 of the chuck member 76. A bolt engaging tab 88 extends across the bore 84. The chuck member 76 has an externally threaded portion 90, and an outer sleeve 92 is provided that has an internally threaded bore for screwing connection with the threaded portion 90. The outer chuck sleeve 92 has a transverse wall 94 and an aperture 96 is disposed in the wall 94.

A dent-engaging member 100 is supportable by the chuck assembly 70 in the following manner. The engaging member 100 is a bolt having a slotted head 102 and a tapered, threaded end 104. The threaded end 104 is selectively sized to be clearingly passed through the aperture 96 in the outer chuck sleeve 92, and the slotted head 102 is selectively sized to at be at least partially receivable in the bore 84 of the chuck member 76 so that the tab 88 is engaged with the slot of the slotted head 102. With the bolt so located, the outer chuck sleeve 92 may tightened onto the chuck member 76 so as to securely fasten the engaging member 100 thereto.

The dent-engaging member 100 may be good quality, self-tapping, metal screw of conventional design. As its purpose is to pullingly engage a dent in the manner to be described below, it is advisable to use a heat treated screw in order to prevent stripping of its threads.

The slide rod 74 has a threaded end 110, and a knob 112 is provided that has a threaded bore for screwing connection to the slide rod 74. The knob 112 is sized and shaped to generally fit the hand of an operator for manual rotation of the slide rod 74 relative to the frame member 12. A locking nut 114 having a threaded aperture therethrough is threadingly engaged on the end 110 of the slide rod 74 between the knob 112 and the frame member 12, and the locking nut 114 is tightened against the knob 112 to securely fasten these members to the slide rod 74. A follower member 116 having an aperture therethrough is clearingly disposed over the slide rod 74, the follower member 116 being located between the locking nut 114 and the frame member 12. The follower member 116 has a first flatted surface 118 and a second flatted surface 120 located on opposing sides thereof so that the lower end 112 of the follower member 116 is disposed between the first tine portion 26 and the second tine portion 28 of the movable handle 20, the follower member 116 being in this manner restrained from rotation about the slide rod 74. Further, the follower member 116 has a first lifting surface 124 near the first flatted surface 118 and a second lifting surface 126 near the second flatted surface 120. The first lifting surface 124 is disposed to be in abutting engagement with the top surface 36 of the first tine portion 26, and the second lifting surface 126 is disposed to be in abutting engagement with the top surface 36 of the second tine portion 28. The first and second lifting surfaces 124 and 126 are curved, cam surfaces designed to be retained in abutting engagement with the curved top surfaces 36 and 37 of the movable handle 20 as the handle 20 is pivoted by the operators hand to the retract position (depicted by the broken lines in FIG. 1), and as the handle 20 is pivoted to the extend position by the action of the spring 80. In regard to the spring 80, force is transmitted by the spring 80 against the chuck assembly 70 to bias the chuck assembly 70 to move in a second direction 83, also called the extending direction. Assuming that the movable handle 20 has been moved by an operator's hand to the retracted position and then released, the spring 80, having been compressed by the movement of the movable handle 20 to the retract position, then exerts force to move the chuck assembly 70 in the extending direction 83, and the force of the spring 80 is brought to bear against the first and second tine portions 26, 28 of the handle 20 via the first and second lifting surfaces 124, 126 to force the handle 20 to assume the extend position as shown in the solid lines of FIG. 1.

Returning to the base plate 54, clearance aperture 128 is disposed in the base plate 54 to permit the free passage therethrough of the threaded end 104 of the dent-engaging member 100. The threaded end 104 serves as a dent contacting portion to connect the dent-engaging member 100 with a dent as shown in FIGS. 1 through 3. A cross sectional view of a metal skin 130 is shown in these figures in autting engagement with the surface 58 of the base plate 54. The skin 130 has an indention or dent 132 that was formed by the application of a striking force in the second direction 83 against the skin 130. The attachment of the dent-engaging member 100 to the dent 132 will be discussed below with the operation of the preferred embodiment.

OPERATION OF THE PREFERRED EMBODIMENT

The operation of the dent-straightening apparatus 10 as illustrated and described in FIGS. 1 through 3 will now be discussed. Briefly, the dent-straightening apparatus 10 comprises the frame member 12, the base plate assembly 40 and the chuck assembly 70, which supports a dent-engaging member 100. A movable handle 20 engages the cammed follower member 116, and the movement of the handle 20 from the extend position to the retract position effects movement of the chuck assembly 70 in the retracting direction 82. The spring 80 is compressed by the movement of the chuck assembly 70 in the retracting direction 82, and upon release of the handle 20, the spring 80 will effect the movement of the chuck assmebly 70 in the extending direction 83 and the return of the handle 20 to the extend position.

Now to describe the operation of the dent-straightening apparatus 10 in its utility purpose, it will be necessary to discuss the operation relative to the body skin 130 and the dent 134 impressed therein. The operator of the dent-straightening apparatus 10 is instructed to place the handle member 20 in the extend position as shown in FIG. 1, and to place the base plate 54 onto the body skin 130 so that the aperture 128 in the base plate 54 generally is over the center of the dent 132. It is noted that the base plate 54 is sized so as to span a larger area than that of the dent 132, such that the base plate 54 is supported by the skin area 140 that is in close proximity, and generally circumscribes, the dent 132. While the size of the base plate 54 is conveniently shown relative to a small dent 132, it will be understood that the base plate 54 may be sized as necessary for a portion of the base plate to be supported on an unmarred portion of the body skin 130. The base plate 54 may be contoured as required so that the surface 58 is appropriately supported on a curved body skin.

The above step has placed the dent-straightening apparatus 10 so that the chuck assembly 70 is above the dent 132, thereby placing the dent-engaging member 100 in contact with the dent 132. The threaded portion 104 of the dent-engaging member 100 has a self-tapping thread for threaded engagement with the dent 132. In some applications, such as when working to straighten dents in automobile bodies, it has been found desirable to drill a small starting hole through the dent 132 near its center to assist in starting the threaded portion 104 therethrough. Once the threaded portion 104 is placed in contact with the center of the dent 132, the knob 112 is manually turned while applying a downward force on the knob 112. This entails the holding of the dent-straightening apparatus 10 in proper position via one hand of the operator holding the stationary handle 14, and the simultaneous pressing and turning of the knob 112 with the palm of the operators other hand. This results in the engagement of the threaded portion 104 with the approximate center of the dent 132. This downward turning force is continued until the dent engaging member 100 is insecure engagement with the dented portion 132 of the skin 130, the object here being to have the dent-engaging member 100 capable of pulling firmly on the dent 132.

To straighten the dent 132, the operator now merely squeezes the gripping portions 16 and 22 of the stationary handle 14 and the movable handle 20 together, causing the upward movement of the handle 20 to the retract position. This in turn causes the movement of the follower 116 (and consequently the chuck assembly 70) in the retracting direction 82 for the reasons discussed above in the description of the construction of the dent-straightening apparatus 10. The movement of the chuck assembly 70 in the retracting direction 82 pulls the dent-engaging member 100 toward the base plate 54. The threaded engagement of the dent-engaging member 100 with the dent 132 causes the upward movement of the chuck assembly 70 to apply a force to the dent 132 in a direction generally opposite to the direction in which it was formed, raising the dented portion toward the base plate 54. The length of each of the handles 14 and 20 are selectively determined so as to provide a large mechanical advantage in forcing the chuck assembly 70 to move against the restraining force offered by the material forces of the dent 132.

Figure 4A:
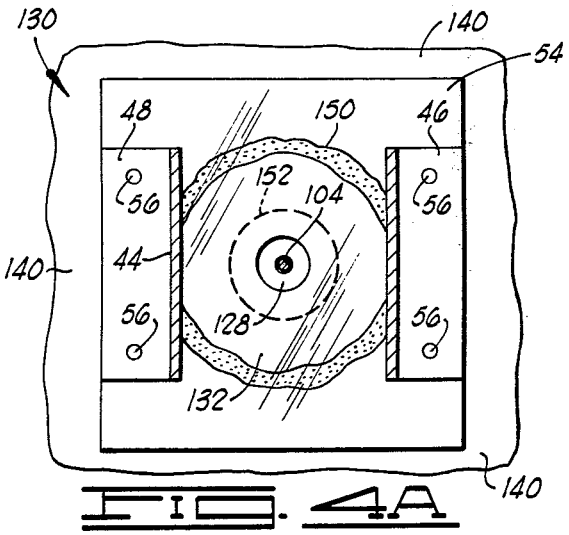
FIG. 4A is a view taken at 4—4 in FIG. 1 to illustrate the reforming stress phenomena observable during operation of the dent-straightening apparatus in one position of the retract assembly.

At this point the reason for making the base plate 54 transparent will be discussed. FIG. 4A is a plan view of the base plate 54 as taken at 4—4 in FIG. 1. When the base plate 54 is placed into abutting contact with the skin 130 as discussed above, the operator can observe the dent through the base plate 54. Once the operator has achieved a start of the connection between the dent-engaging member 100 and the dent 132, the continued turning of the knob 112 by the operator will cause the base plate 54 to be firmly abutted against the unmarred skin area 140 that surrounds the dent 132. As depicted in FIG. 4A, an unusual phenomenon occurs at this point as a line of stress 150 will be observable to the operator. This line of stress will usually appear roughly as a circle about the dent 132.

Figure 4B:
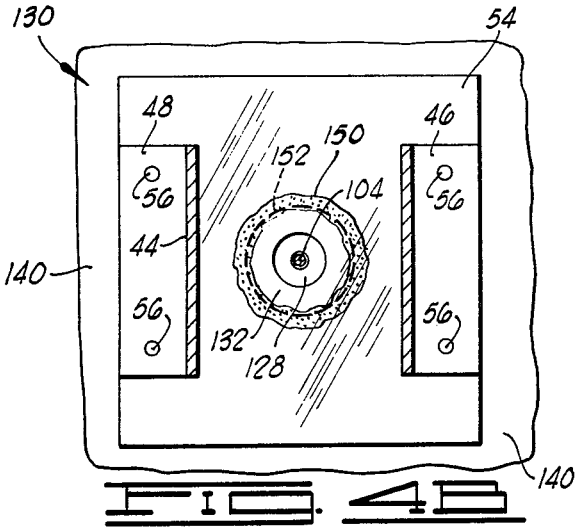
FIG. 4B is also a view taken at 4—4 in FIG. 1 to illustrate the reforming stress observable at another position of the retract assembly.

When the operator begins to manipulate the handles 14 and 20 to raise the dented portion 132 toward the base plate 54, the operator will notice that the line of stress 150 will converge towards its center, and if the line of stress 150 has taken the form of a circle, this circle will decrease in diameter as the dent 132 is straightened. This is depicted in FIG. 4B, which is a view similar to FIG. 4A and which shows the line of stress 150 having moved toward the center of the dent, that is, toward the point at which the force is being applied by the dent-engaging member 100. Thus, the operator can visually observe the progress of the dent-straightening process, and he can easily prevent over-pulling of the dent by simply observing the location of the line of stress 150.

In the practical application of the dent-straightening apparatus 10 to remove dents in the body of an automobile, it is usually advisable to stop the raising of the dent by the dent-straightening apparatus 10 at a point where the approximate center of the dent is still recessed slightly. The reason for this is that the hole that remains after the dent-engaging member 100 is removed from the skin 130 must be filled with a filler material in a manner that is well-known in automobile repair techniques, and it is therefore usually advisable to fill a small amount of the dented portion around the hole as well. In such an application, it has been found to be a good practice to stop the operation of the dent-straightening apparatus 10 when the line of stress 150 has been reduced to approximately the size of a dime coin, or about 17 centimeters in diameter. At this point, the operator is assured that the dent has not been overpulled and that there remains a slight indentation for proper filling. As an aid in helping the operator to judge when to stop the operation of the dent-straightening apparatus 10, a gauge line 152 is shown in FIGS. 4A and 4B as a fixed marking on the base plate 54. When the line of stress 150 has been decreased so that it appears under the gauge line 152, the operator knows that the dent has been properly raised, further operation of the dent-straightening apparatus 10 may be ceased, and the dent-engaging member 100 may be disengaged from the dent 132 by rotating the knob 112 in the opposite direction to that which was turned to engage the dent. Of course, it may be that other forms of gauge markings may be desired, and these may be readily added as required to the base plate 54.

The result of raising the material of the dent 132 to its position prior to the dent being formed is that the dented portion has been repaired with the only remaining distrubance to the skin 130 being the hole which was placed in the center of the dent 132, and this can be readily repaired by known surface repair techniques and procedure. The present invention permits an operator to rapidly reapir indentations in body skins which are not accessible from the underside, and the transparent base plate permits the operator to observe the dent removing process so that the operator remains in control of the dented portion throughout the process. The base plate 54 serves as a backup means against which the dented portion 130 is forced, providing relative level repair surface.

It is clear from the description of the preferred embodiment along with the discussion of its operation that the present invention is well-adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. An apparatus for repairing a dented portion of a metal skin, comprising:

a frame;

a transparent base plate supported by the frame, the base plate having a clearance aperture extending through the medial portion thereof;

a chuck assembly slidingly supported on the frame on one side of the base plate for movement in a retracting direction away from the base plate;

a dent-engaging member supported by the chuck assembly, the dent-engaging member having a portion extending through the clearance aperture into engagement with the dented portion; and means supported by the frame for moving the chuck assembly and the dent-engaging member in the retracting direction whereby the dented portion is drawn toward the base plate to a predetermined position as observed via the transparent base plate.

2. The apparatus of claim 1 wherein the chuck assembly is characterized as comprising:

a slide rod slidably supported by the frame;

a chuck attached to one end of the slide rod and characterized as comprising:

a chuck member attached to the slide rod and having a treaded end with a bore therein;

a bolt engaging tab supported by the chuck member in the bore; and an outer chuck sleeve threadingly engagable with the threaded end of the chuck member, the chuck sleeve cooperating with the chuck member to support the dent-engaging member.

3. The apparatus of claim 2 wherein the dent-engaging member is characterized as comprising:

a bolt supported by the chuck, the bolt comprising a threaded end portion sized to extend through the clearance aperture into engagement with the dent portion of the metal skin without contacting the base plate, and a head having a slot engagable with the bolt engaging tab.

4. The apparatus of claim 2 wherein the means for moving the chuck assembly is characterized as comprising:

a stationary handle supported by the frame;

a movable handle pivotally supported by the frame; and means for moving the slide rod in the retracting direction when the movable handle is pivoted towards the stationary handle.

5. The apparatus of claim 4 further characterized as comprising:

a knob attached to the end of the slide rod opposite the chuck member;

wherein the movable handle has a tines portion; and wherein the means for moving the slide rod in the retracting direction comprises:

a follower member slidingly supported on the slide rod between the knob and the frame, the follower member engaging the tines portion of the movable handle and transmitting force applied to the follower member via the movable handle to the knob when the movable handle is pivoted towards the stationary handle, whereby the chuck assembly is moved in the retracting direction.

6. The apparatus of claim 4 further characterized as comprising:

means for biasing the chuck assembly for movement in an extending direction opposite to the retracting direction.

7. The apparatus of claim 1 wherein the base plate has a gauge for indicating the position of lines of stress.

* * * * *